US011414227B2

(12) United States Patent
Kooc et al.

(10) Patent No.: US 11,414,227 B2
(45) Date of Patent: Aug. 16, 2022

(54) APPARATUS FOR APPLYING A MULTI-CAN ENGAGEMENT COLLAR TO A GROUP OF BEVERAGE CANS

(71) Applicant: WestRock Packaging Systems, LLC, Atlanta, VA (US)

(72) Inventors: Lihn L. Kooc, Richmond, VA (US); Matthew E. Zacherle, Chesterfield, VA (US)

(73) Assignee: WESTROCK PACKAGING SYSTEMS, LLC, Atlanta, GA (US)

( * ) Notice: Subject to any disclaimer, the term of this patent is extended or adjusted under 35 U.S.C. 154(b) by 0 days.

(21) Appl. No.: 16/977,016

(22) PCT Filed: Feb. 22, 2019

(86) PCT No.: PCT/US2019/019104

§ 371 (c)(1),
(2) Date: Aug. 31, 2020

(87) PCT Pub. No.: WO2019/168747

PCT Pub. Date: Sep. 6, 2019

(65) Prior Publication Data

US 2021/0002010 A1 Jan. 7, 2021

Related U.S. Application Data

(60) Provisional application No. 62/637,118, filed on Mar. 1, 2018.

(51) Int. Cl.

| | |
|---|---|
| ***B65B 17/00*** | (2006.01) |
| ***B65B 17/02*** | (2006.01) |
| ***B65B 27/04*** | (2006.01) |
| ***B65B 67/00*** | (2006.01) |

(52) U.S. Cl.
CPC ..... *B65B 17/025* (2013.01); *B65B 27/04* (2013.01); *B65B 67/00* (2013.01)

(58) Field of Classification Search
CPC ..... B65B 17/00; B65B 17/02; B65B 17/025; B65B 27/00; B65B 27/04
USPC ..... 53/398
See application file for complete search history.

(56) References Cited

U.S. PATENT DOCUMENTS

| | | | | |
|---|---|---|---|---|
| 2,929,181 | A * | 3/1960 | Poupitch | B65B 17/025 53/398 |
| 4,392,337 | A | 7/1983 | Hara | |
| 5,125,206 | A | 6/1992 | Galbierz | |

(Continued)

*Primary Examiner* — Chelsea E Stinson
(74) *Attorney, Agent, or Firm* — Neil G. Cohen; Brian J. Goldberg

(57) ABSTRACT

An apparatus for applying an engagement collar to a group of articles, which includes an application area defining a horizontal support surface for receiving a group of articles, a horizontal press plate positioned above the support surface and mounted for vertical movement relative to the support surface, and an actuation assembly operatively connected to the press plate for moving the press plate relative to the support surface to apply an engagement collar to the group of articles positioned on the support surface within the application area, wherein the actuation assembly includes an actuation lever that is located below the press plate and in front of the application area to provide an ergonomic work environment.

19 Claims, 16 Drawing Sheets

(56) References Cited

U.S. PATENT DOCUMENTS

| | | | | |
|---|---|---|---|---|
| 5,791,121 | A * | 8/1998 | Bernier | B65B 17/025 53/390 |
| 6,076,331 | A * | 6/2000 | Granbakken | B65D 71/42 53/398 |
| 2019/0233145 | A1* | 8/2019 | Kooc | B65B 17/025 |
| 2021/0261279 | A1* | 8/2021 | Zacherle | B65B 35/30 |

* cited by examiner

APPARATUS FOR APPLYING A MULTI-CAN ENGAGEMENT COLLAR TO A GROUP OF BEVERAGE CANS

BACKGROUND OF THE INVENTION

1. Field of the Invention

The subject invention is directed to packaging, and more particularly, to an apparatus for applying a multi-can engagement collar to a group of beverage cans to secure them together within a package.

2. Description of Related Art

In the field of packaging it is often required to provide consumers with a package consisting of multiple product containers, for example, aluminum beverage cans. The product containers may be held together within the package by an engagement device such that a group of containers can be selected and transported as a single unit. Once such top engagement device is formed from plastic and includes a series of linked rings, often referred to as yokes. These yokes or six-pack rings fit over the rimmed edges of a group of beverage cans.

There are disadvantages associated with using such plastic rings or yokes for grouping beverage cans. For example, the plastic material from which the yokes are made cannot be easily printed on to provide marketing, branding and promotional indicia. In order to provide an improvement in this field, multi-can engagement collars have been developed that are constructed from paperboard materials, which are more easily printed on.

Applicator machines have also been developed to apply these paperboard multi-can engagement collars to a group of beverage cans. However, these prior art applicator devices are cumbersome and fairly difficult to use and they do not provide for an ergonomic work environment.

One such prior art applicator device requires a user to awkwardly reach over the top of the machine to pull down on an overhead actuation handle adapted to move a press plate, which applies the paperboard engagement collar to a group of beverage cans located on a surface below the press plate. This awkward design required improvement, which led to the apparatus of the subject invention that overcomes the disadvantaged note above.

SUMMARY OF THE DISCLOSURE

The subject invention is directed to a new and useful packaging apparatus for applying a yoke to a group of articles, and more particularly, for applying an engagement collar to a group of cylindrical containers, such as beverage cans or the like. The apparatus includes an application area defining a horizontal support surface for receiving a group of articles, a horizontal press plate positioned above the support surface and mounted for vertical movement relative to the support surface, and an actuation assembly operatively connected to the press plate for moving the press plate relative to the support surface to apply an engagement collar to a group of articles positioned on the support surface within the application area.

In accordance with a preferred embodiment of the subject invention, the actuation assembly that moves the press plate relative to the support surface includes an actuation lever that is located in a readily accessible location below the press plate and in front of the application area, to provide an ergonomic work environment.

The actuation assembly includes a support frame having a pair of stanchions extending vertically upward from the support surface and a support shaft extending horizontally between the pair of stanchions. The actuation assembly further includes a rocker arm mounted for rotation about the support shaft, and wherein a front end portion of the rocker arm is operatively connected to the horizontal press plate and a rear end portion of the rocker arm is operatively connected to the actuation lever. The actuation assembly further includes a ram shaft extending vertically upward from the horizontal press plate and including a pivot block to connect the ram shaft to the front end portion of the rocker arm.

The support frame of the actuation assembly further includes an outrigger extending horizontally forward from each stanchion, and wherein each outrigger includes a sleeve bearing that supports a guide shaft extending vertically upward from the press plate. The ram shaft is configured as a threaded shaft and is adapted to adjust the initial height of the horizontal press plate relative to the support surface, to accommodate to accommodate articles or containers of varying size.

Preferably, the initial height of the actuation lever relative to the support surface is adjustable. More preferably, the height of the actuation lever is adjusted by an extendible and retractable turnbuckle assembly operatively extending between the rear end portion of the rocker arm and a rear end portion of the actuation lever. Preferably, the support surface is mounted on height adjustable telescopic support legs, and each support leg includes a caster having a break mechanism.

The apparatus further includes an applicator plate that is adapted and configured for positioning between the press plate and an engagement collar. A rack may be located on top of the actuation assembly for holding a plurality of the engagement collars. Alternatively, a rack may be located below the support surface for holding a plurality of the engagement collars.

The subject invention is also directed to an apparatus for applying a multi-can engagement collar to a group of beverage cans that includes an application area defining a horizontal support surface for receiving a group of beverage cans, a horizontal press plate positioned above the support surface and mounted for vertical movement relative to the support surface from an initial height, a mechanism for selectively adjusting the initial canning height of the press plate to accommodate beverage cans of varying size, and an actuation assembly operatively connected to the press plate for moving the press plate relative to the support surface to apply a multi-can engagement collar to a grouping of beverage cans positioned on the support surface within the application area.

The actuation assembly includes a support frame having a pair of stanchions extending vertically upward from the support surface and a support shaft extending horizontally between the pair of stanchions. The actuation assembly further includes a rocker arm mounted for rotation about the support shaft, wherein a front end portion of the rocker arm is operatively connected to the horizontal press plate and a rear end portion of the rocker arm is operatively connected to the actuation lever. Preferably, the mechanism for selectively adjusting the initial canning height of the press plate includes a threaded ram shaft that extends vertically upward from the horizontal press plate. The ram shaft is mounted for movement relative to a pivot block that connects the ram shaft to the front end portion of the rocker arm in response to rotation of a pair of adjustable bolts positioned above and below the pivot block.

The subject is further directed to an apparatus for applying a multi-can engagement collar to a group of beverage cans that includes an application area defining a horizontal support surface for receiving a group of beverage cans, a horizontal press plate positioned above the support surface and mounted for vertical movement relative to the support surface, an actuation handle operatively connected to the press plate for moving the press plate relative to the support surface to apply a multi-can engagement collar to a group of beverage cans positioned on the support surface within the application area, wherein the actuation handle has an initial height relative to the support surface, and a mechanism for selectively adjusting the initial height of the actuation handle relative to the support surface to accommodate a user.

The actuation assembly includes a support frame having a pair of stanchions extending vertically upward from the support surface and a support shaft extending horizontally between the pair of stanchions. The actuation assembly further includes a rocker arm mounted for rotation about the support shaft, wherein a front end portion of the rocker arm is operatively connected to the horizontal press plate and a rear end portion of the rocker arm is operatively connected to the actuation handle.

Preferably, the mechanism for adjusting the initial height of the actuation handle includes an extendible and retractable turnbuckle assembly operatively extending between the rear end portion of the rocker arm and a rear end portion of the actuation handle. The turnbuckle assembly includes an upper threaded clevis portion connected to the rear end portion of the rocker arm, a lower threaded clevis portion connected to the rear end portion of the actuation handle, and a central coupling adjustably connecting the upper and lower threaded clevis portions to one another.

These and other features of the apparatus of subject invention and the method of using the same will become more readily apparent to those having ordinary skill in the art to which the subject invention appertains from the detailed description of the preferred embodiments taken in conjunction with the following brief description of the drawings.

BRIEF DESCRIPTION OF THE DRAWINGS

So that those skilled in the art will readily understand how to make and use the packaging apparatus of the subject invention without undue experimentation, preferred embodiments thereof will be described in detail herein below with reference to the figures wherein.

DETAILED DESCRIPTION OF THE PREFERRED EMBODIMENTS

Figure 1:
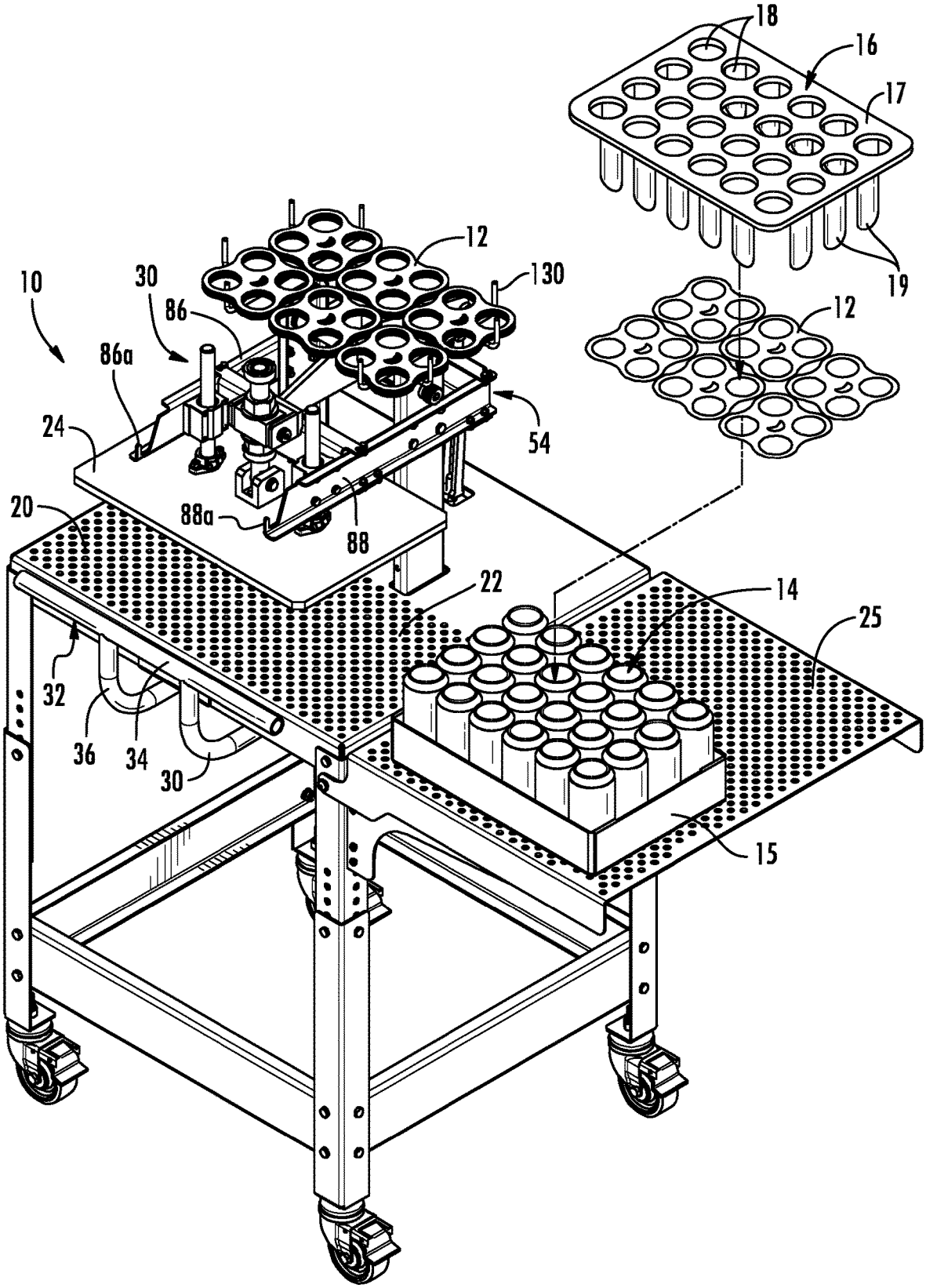
FIG. 1 is a perspective view of an apparatus for applying a multi-can engagement collar to a grouping of beverage cans, which is constructed in accordance with a preferred embodiment of the subject invention, along with a package of beverage cans to be grouped together, a multi-can engagement collar for grouping the beverage cans together and an applicator plate for applying the engagement collar to the group of beverage cans in conjunction with the apparatus.

Referring now to the drawings, wherein like reference numerals identify similar structural elements and features of the subject invention, there is illustrated in FIG. 1 an apparatus for packaging a plurality of similar articles or containers in a convenient manner, and more particularly, to an apparatus 10 for applying a multi-can engagement collar 12 to a group of beverage cans 14 in a package 15 using an applicator plate 16. A key feature of the apparatus 10, which will be explained in greater detail below, is that the handle of actuation assembly 30 used to operate the apparatus 10 is located in an easily accessible and convenient location relative to the work area 20 to provide an ergonomic work environment for a user.

Referring now to FIG. 1, the multi-can engagement collar 12 is stamp formed from a suitable substrate material that can be easily printed on. For example, the substrate material from which the collar 12 is formed can be paperboard, corrugated board, cardboard or the like. The substrate material may be laminated, so as to provide strength and rigidity. For example, a plastic laminate may be applied to the substrate material. Alternatively, the substrate material may be formed without a laminate, and thus, it may be biodegradable or recyclable.

As illustrated herein, the multi-can engagement collar 12 is designed to be separated into a plurality of 4-pack sections. However, those skilled in the art will readily appreciate that the multi-can engagement collar 12 could be designed so that it is inseparable. Those skilled in the art will further appreciate that the multi-can engagement collar 12 could be designed to separate into a many different sized sections, and it could be designed to accommodate more than or less than 24 beverage cans, as is depicted herein. For example, the multi-can engagement collar 12 could be designed to be separated into a plurality of 6-pack sections, without departing from the spirit or scope of the subject application.

The applicator plate 16 is adapted and configured to apply the multi-can engagement collar 12 to the tops of the beverage cans 14 grouped in package 15, through the use of apparatus 10. The applicator plate 16 is formed from a rigid material, such as metal or a hardened plastic material. It includes an upper plate 17 having a plurality of apertures 18 formed therein (e.g., twenty-four apertures). Each aperture 18 corresponds to a respective beverage can 14 in the package 15. The apertures 18 are dimensioned to accommodate the reduced diameter of the upper end of the beverage cans 14. A plurality of fingers 19 depend from the lower surface of the upper plate 17 for engaging the outer peripheries of the beverage cans 14 on the outer periphery of the package 15, to stabilize the group of cans 14 and ensure the integrity of the engagement between the collar 12 and the cans 14.

Referring now to FIGS. 2 through 5, the apparatus 10 is designed as a mobile unit that can be positioned at a desirable location within a work environment. For example, the apparatus 10 can be positioned adjacent to a ready supply of beverage cans. This is in sharp contrast to prior art apparatus of this type that were designed for placement on a table top, and were not easily transportable in a work environment. The apparatus 10 includes an application area 20 defining a horizontal support surface 22 for receiving the group of beverage cans 14 in package 15. A horizontal press plate 24 is positioned above the support surface 22 and it is mounted for vertical movement relative to the support surface 22.

An actuation assembly 30 is operatively connected to the press plate 24 for moving the press plate 24 relative to the support surface 22 to apply the multi-can engagement collar 12 to a group of beverage cans 14 positioned on the support surface 22 within the application area 20. In accordance with a preferred embodiment of the subject invention, the actuation assembly 30 that moves the press plate 24 includes an actuation lever 32 that is located in a readily accessible location below the press plate 24 and in front of the application area 20, to provide an ergonomic work environment. This is an advantage over prior art applicator machines, where the actuation lever was located above the press plate in a location that was difficult to access by a user.

The actuation lever 32 includes a horizontal handle bar 34 that is connected to a pair of lever rods 36 and 38. The lever rods 36 and 38 extend downwardly from the handle bar 34 and then below the support surface 22 to a rear cross-bar 40, best seen in FIG. 3. The rear cross-bar 40 is pivotally supported by a pair of parallel brackets 42 and 44 that are welded to or otherwise mounted beneath the horizontal support surface 22 of apparatus 10.

The actuation assembly 30 includes a support frame 54 having a pair of stanchions 56 and 58 that extend vertically upward from the support surface 22. A support shaft 60 extends horizontally between the pair of stanchions 56 and 58, and a spring biased rocker arm 62 is mounted for rotation about the support shaft 60. A front end portion 62*a* of the rocker arm 62 is operatively connected to the horizontal press plate 24 through additional structure described below and a rear end portion 62*b* of the rocker arm 62 is operatively connected to the cross-bar 40 of actuation lever 32 by way of an adjustable turnbuckle 64, as best seen in FIG. 3.

Figure 4:
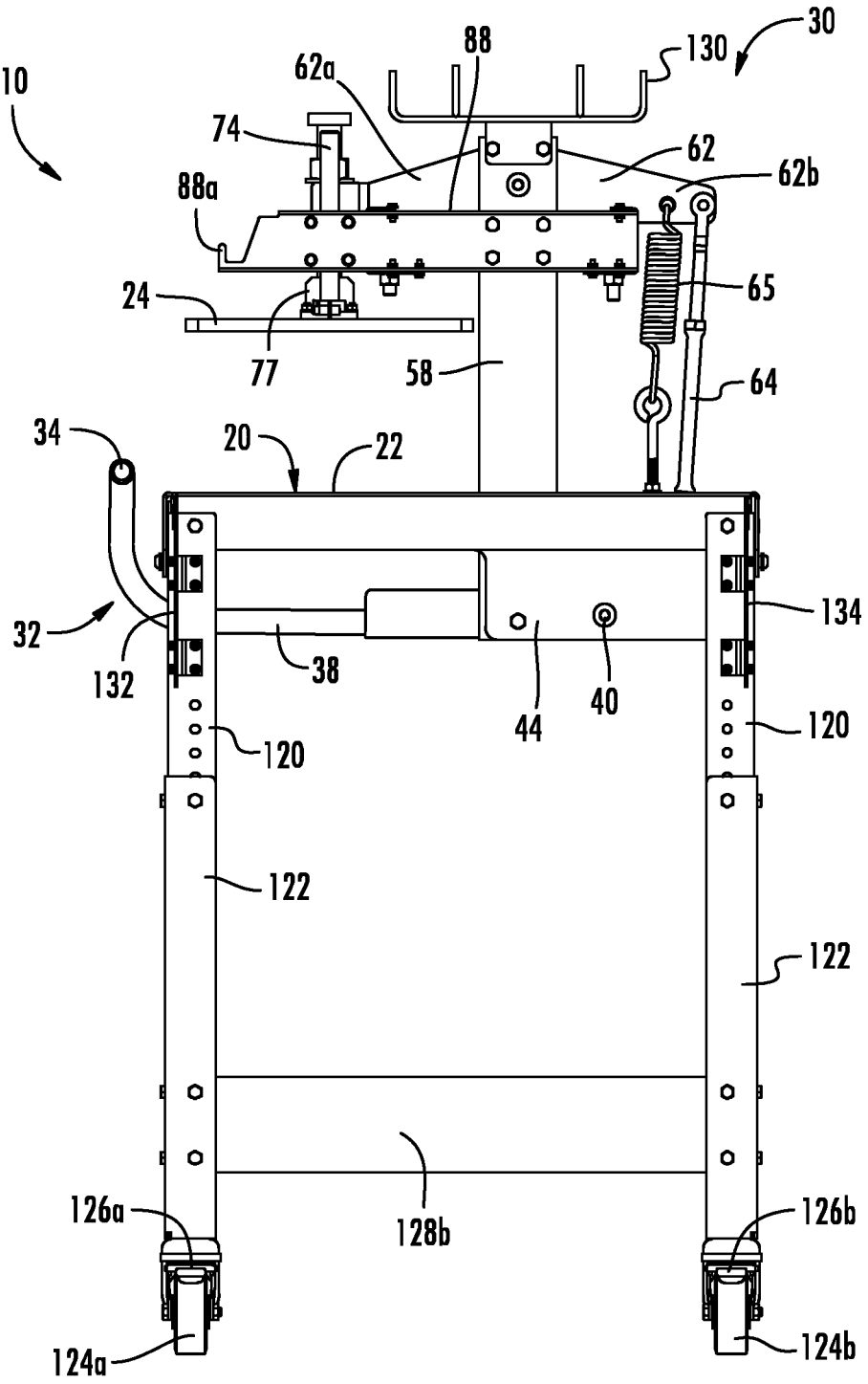
FIG. 4 is a side elevational view of the apparatus shown in FIG. 1.
Figure 5:
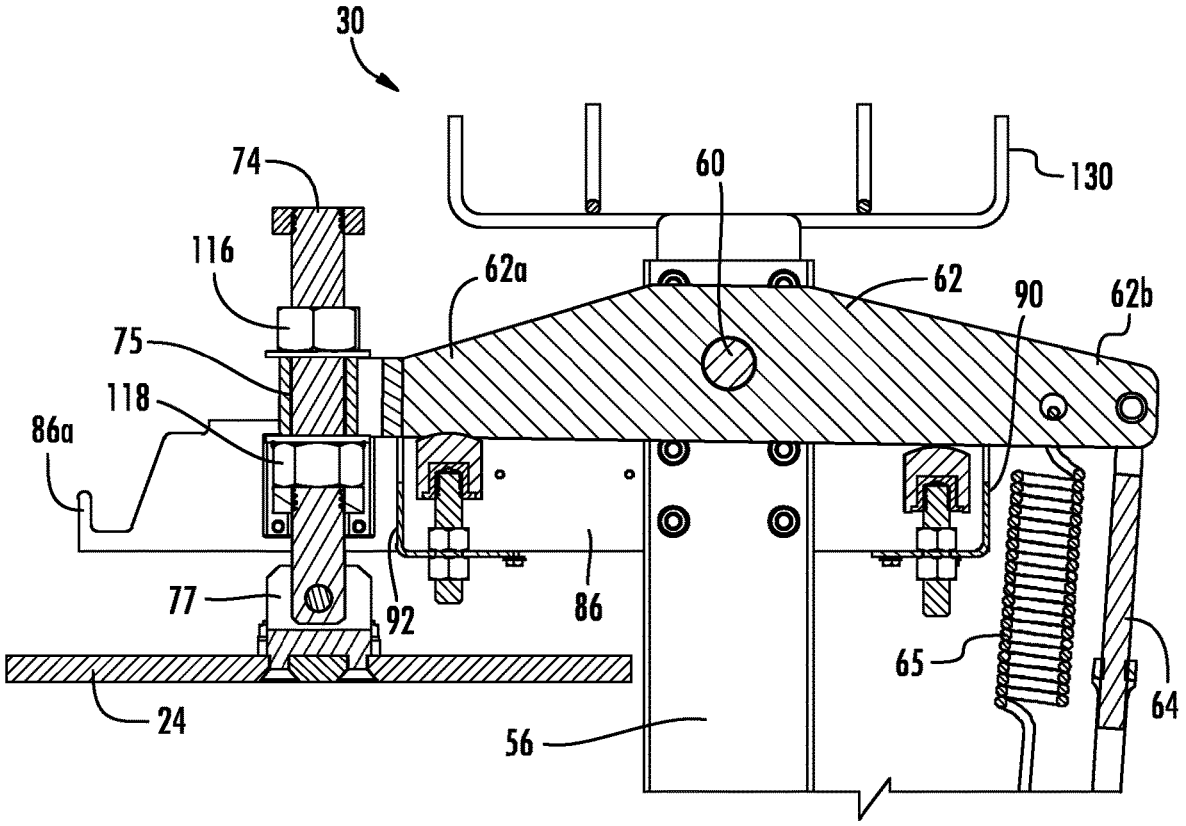
FIG. 5 is an enlarged localized cross-sectional view of the actuation assembly of the apparatus shown in FIG. 1, taken along line 5-5 of FIG. 3.

Referring to FIGS. 4 and 5, an adjustable coiled tensioning spring 65 extends between the rear end portion 62*b* of rocker arm 62 and the support surface 22 for controlling the actuated movement of rocker arm 62. The actuation assembly 30 further includes a height-adjustable ram shaft 74 that extends vertically upward from a clevis mount 77 welded to the horizontal press plate 24 and includes a central pivot block 75 that operatively connects the ram shaft 74 to the front end portion 62*a* of the rocker arm 62.

Figure 9:
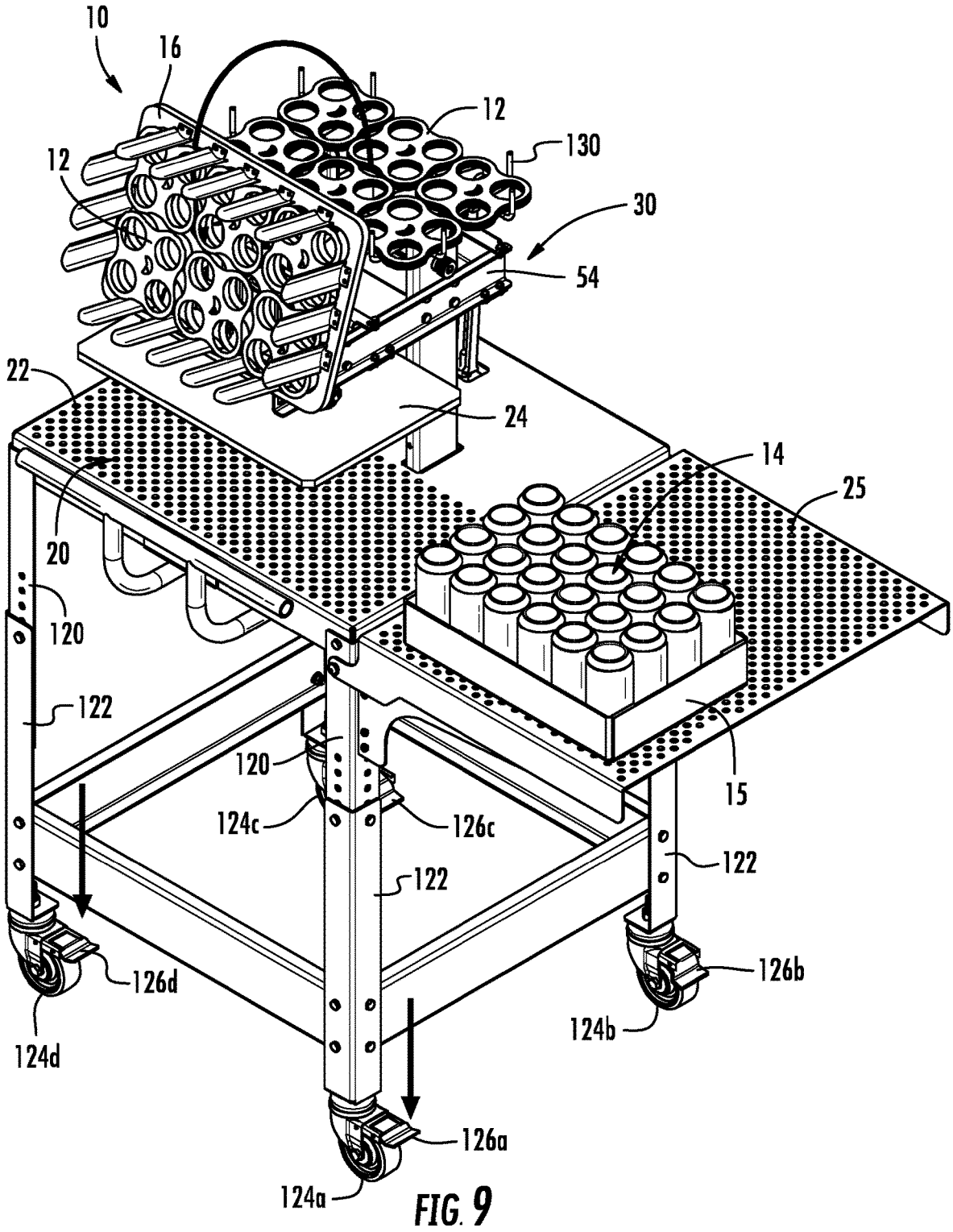
FIG. 9 is a perspective view of the apparatus of FIG. 1, illustrating the placement of a multi-can engagement collar into the applicator plate retained in its stowed position.

The support frame 54 of actuation assembly 30 further includes outrigger beams 86 and 88 extending horizontally forward from respective stanchions 56 and 58, and front and rear cross-brackets 90 and 92 extend between the rear ends of the outrigger beams 86 and 88. Each outrigger beam 86, 88 has a respective sleeve bearing 96, 98 associated with an interior surface thereof that supports the vertical movement of a guide shaft 106,108 extending vertically upward from the press plate 24. The front ends of outrigger beams 86 and 88 are configured as retention hooks 86*a* and 88*a*, respectively, which are adapted and configured to retain the applicator plate 16 when it is not in use, as best seen in FIG. 9.

Figure 2:
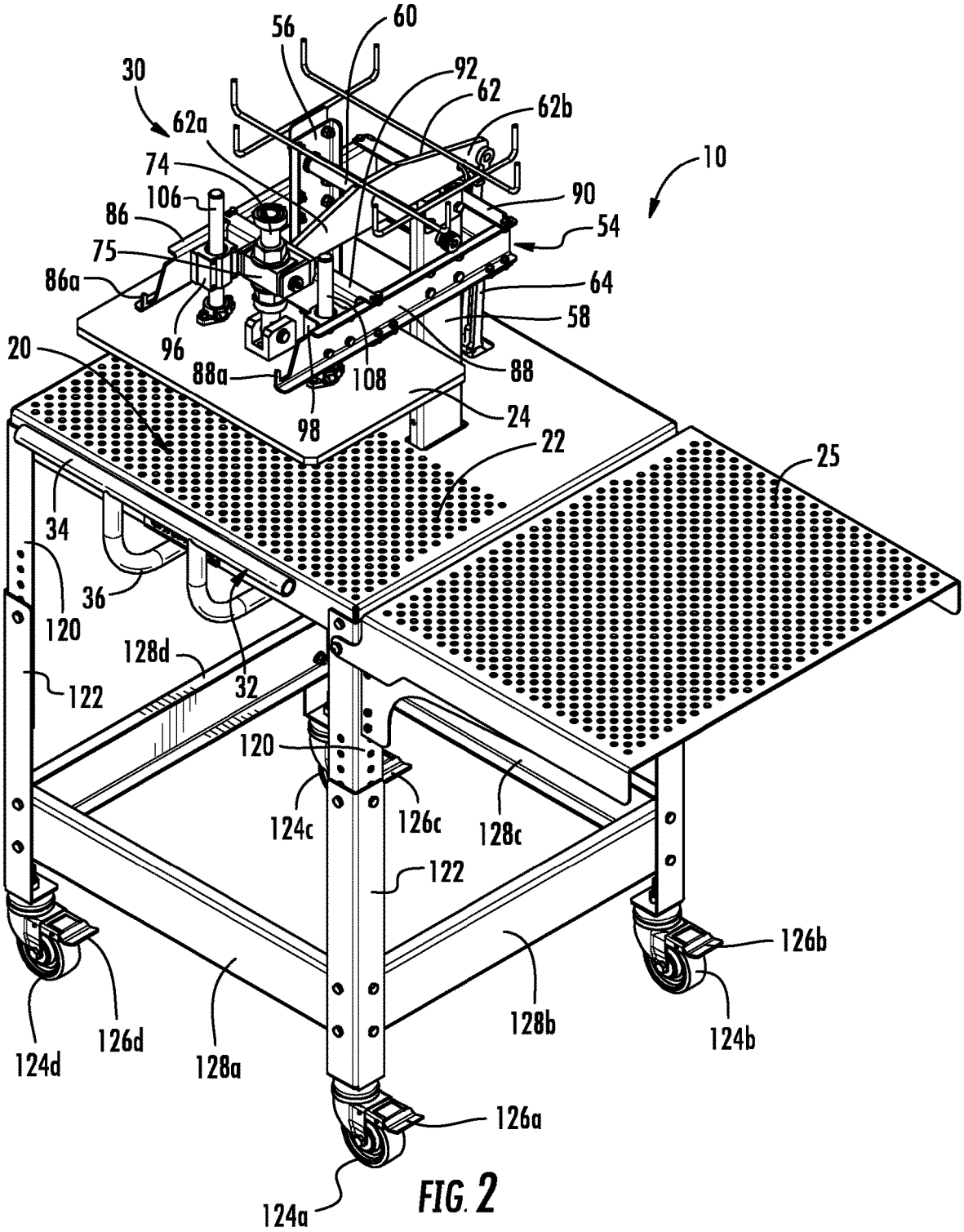
FIG. 2 is a perspective view of the apparatus shown in FIG. 1.
Figure 3:
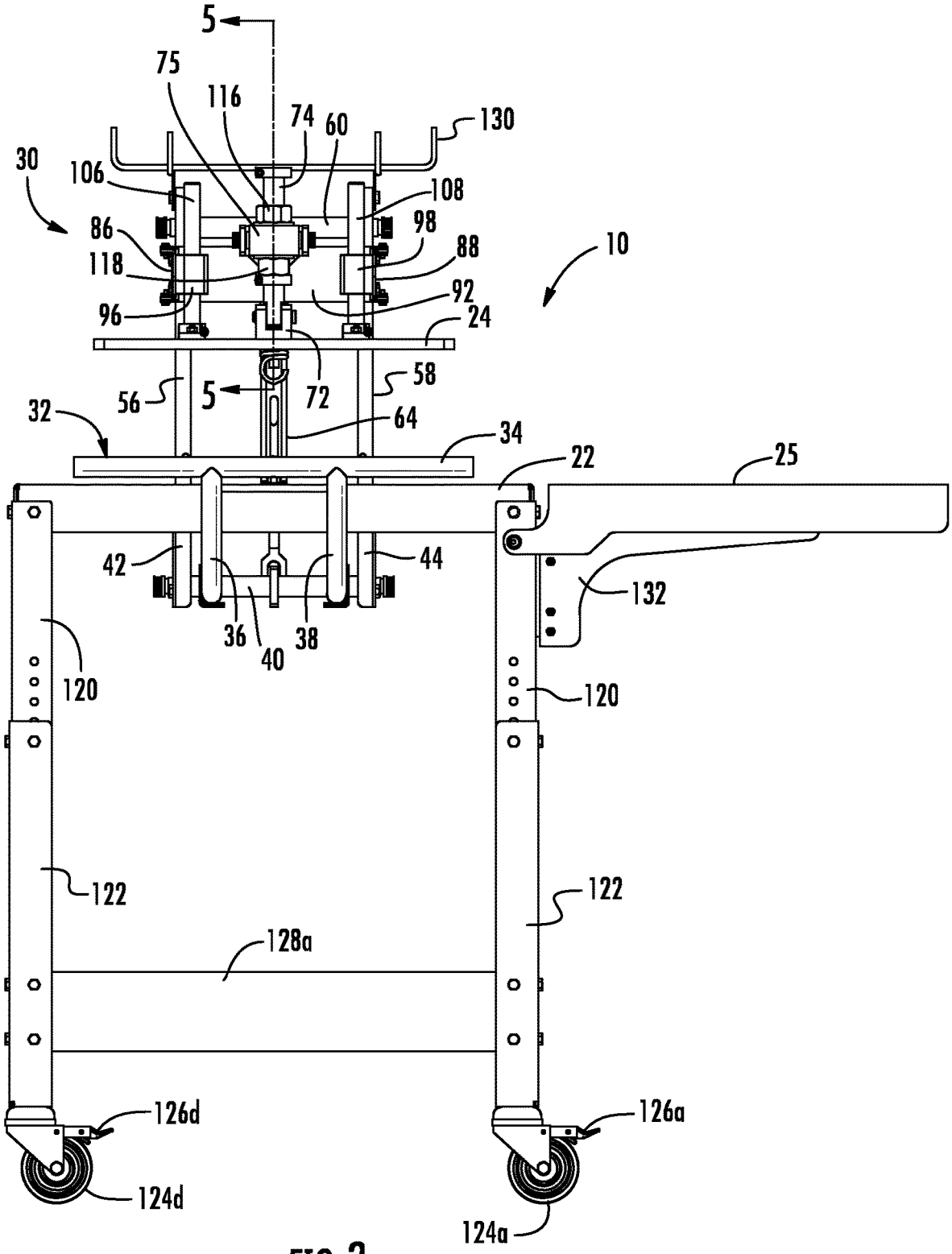
FIG. 3 is a front plan view of the apparatus shown in FIG. 1.

With continuing reference to FIGS. 2 through 4, the support surface 22 is mounted on four height-adjustable support legs each having an upper leg portion 120*a*-120*d* and a lower leg portion 122*a*-122*d*. The upper and lower leg portions are telescopically connected together to facilitate the height adjustments. In addition, each lower leg portion 122*a*-122*d* includes a respective caster 124*a*-124*d* having a brake mechanism 126*a*-126*d* to lock its respective castor from rolling. Horizontal leg supports 128*a*-128*d* extend between the lower leg portions 122*a*-122*d* to provide structural stability to the apparatus 10.

Figure 6:
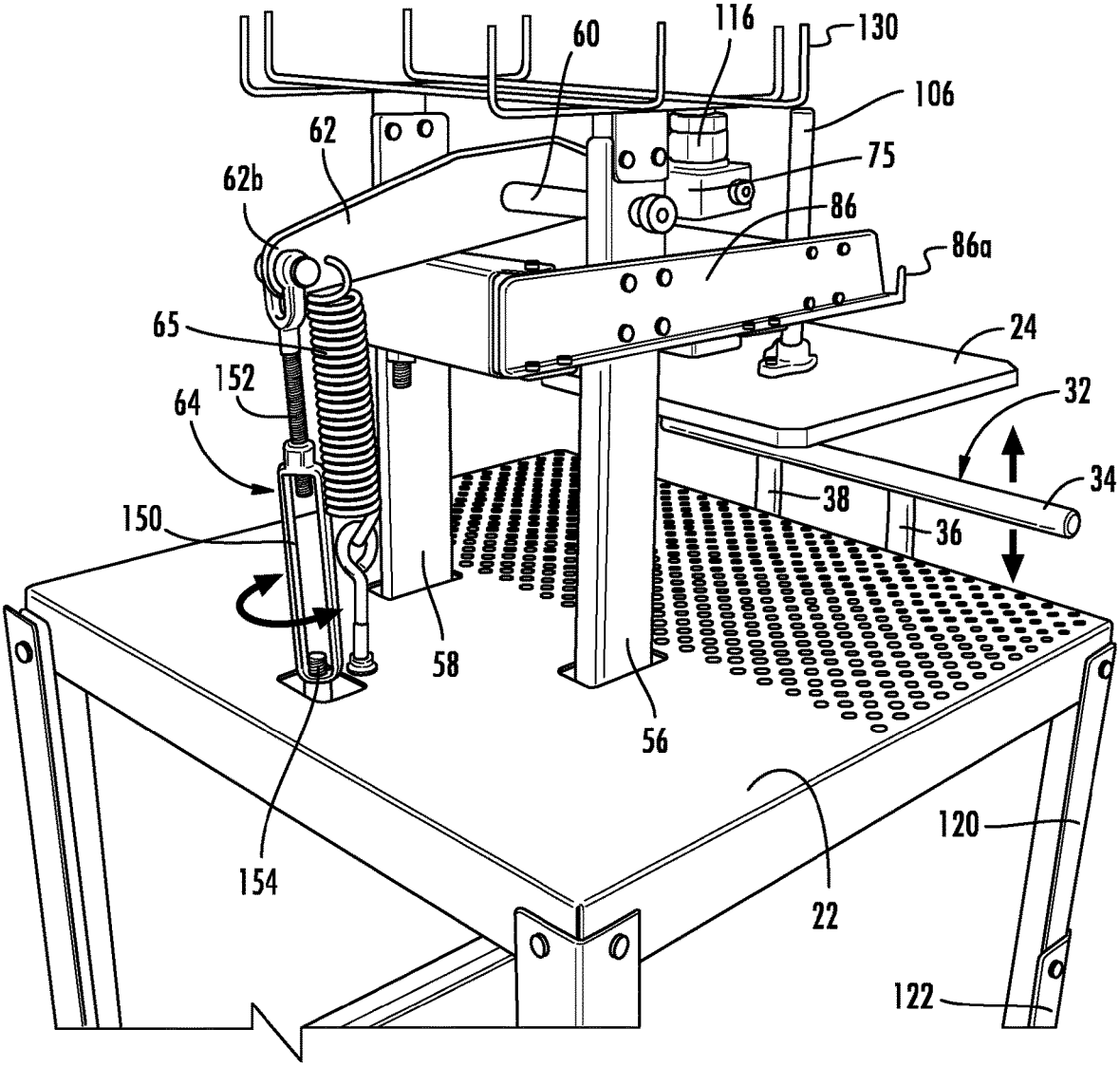
FIG. 6 is an enlarged localized perspective view, looking at the rear of the apparatus of FIG. 1, illustrating the mechanism for adjusting the initial height of the actuation handle relative to the support surface.

Referring to FIG. 6, in accordance with a preferred embodiment of the subject invention, the height of the actuation handle 34 of actuation lever 32 relative to the horizontal support surface 22 of apparatus 10 can be readily adjusted by a user. More specifically, the initial starting height of the actuation handle 34 can be adjusted by changing the length of the turnbuckle 64 that operatively extends between the rear end portion 62*b* of the rocker arm 62 and the rear cross-bar 40 of actuation lever 32.

In use, when the central coupling 150 of turnbuckle 64 is rotated in a clockwise direction, the upper and lower threaded clevis portions 152 and 154 will move toward one another within central coupling 150, increasing the length of the turnbuckle 64 and causing the actuation handle 34 to pivot upwardly relative to the support surface 22. In contrast, when the central coupling 150 of turnbuckle 64 is rotated in counter-clockwise, the upper and lower threaded clevis portions 152 and 154 will move apart from one another within central coupling 150, decreasing the length of turnbuckle 64 and causing actuation handle 34 to pivot downwardly relative to support surface 22.

Figure 7:
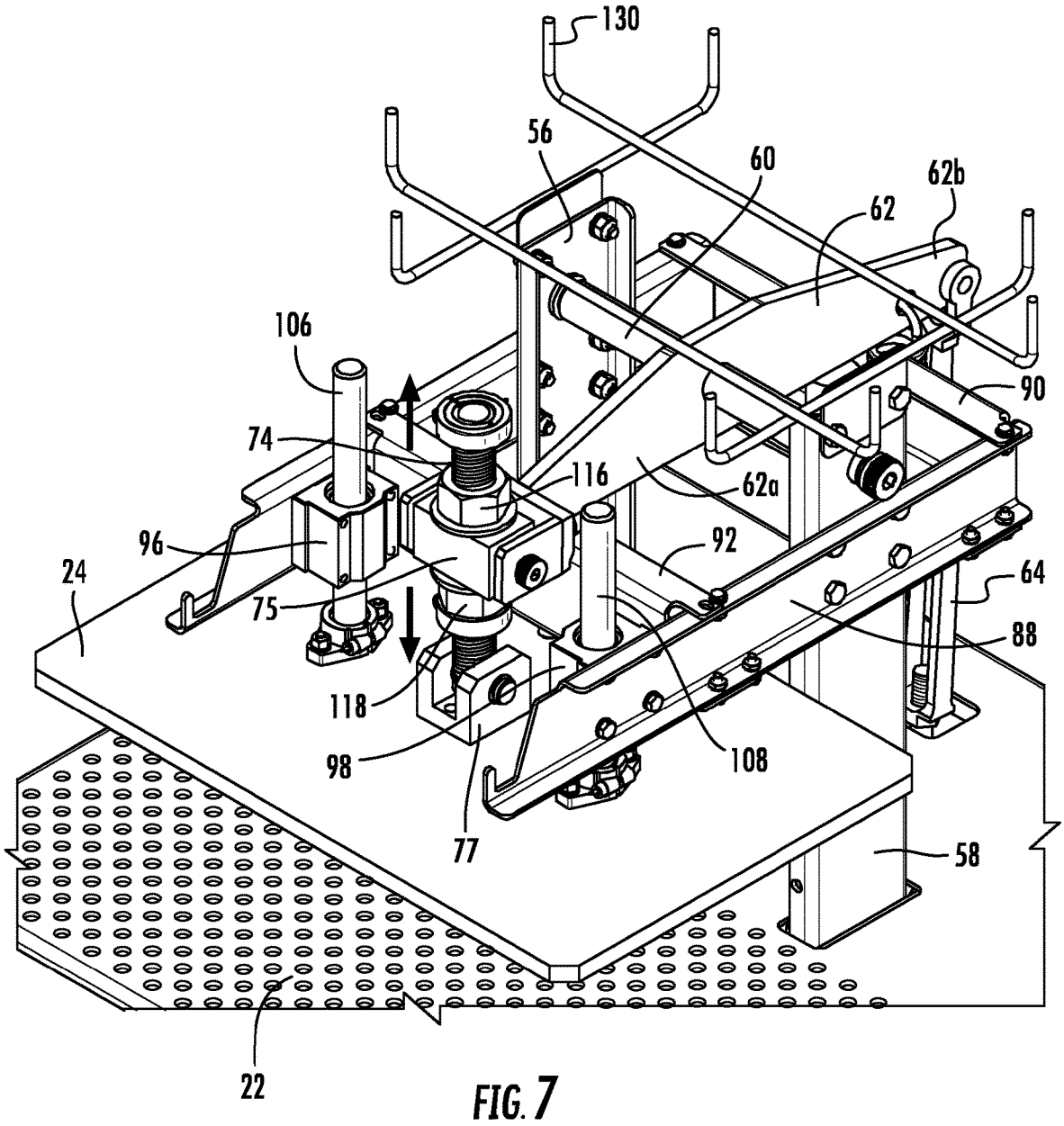
FIG. 7 is an enlarged localized perspective view looking at the top of the apparatus of FIG. 1, illustrating the mechanism for adjusting the initial height of the press plate relative to the support surface.

Referring to FIG. 7, the height-adjustable ram shaft 74 is configured as a threaded shaft that is adapted for adjusting the initial canning height of the horizontal press plate 24 relative to the support surface 22 to accommodate beverage cans of varying size, for example, twelve-ounce beverage cans versus sixteen-ounce beverage ounce cans. More specifically, upper and lower threaded adjustment bolts 116 and 118 are operatively associated with ram shaft 74, and when they are rotatably adjusted relative to the ram shaft 74, the press plate 24 moves vertically relative to support surface 22 to adjust the initial height of the press plate 24.

In use, the initial height of the press plate 24 can be raised or lowered relative to the horizontal support surface 22, by adjusting the position of the ram shaft 74 relative to the pivot block 75, using the threaded adjustment bolts 116 and 118. At such a time, the initial positions of the guide shafts 106 and 108 will change with respect to their sleeve bearing 96 and 98, but the initial starting position of the front end portion 62*a* of rocker arm 62, which is connected to the pivot block 75, will remain unchanged.

Figure 8:
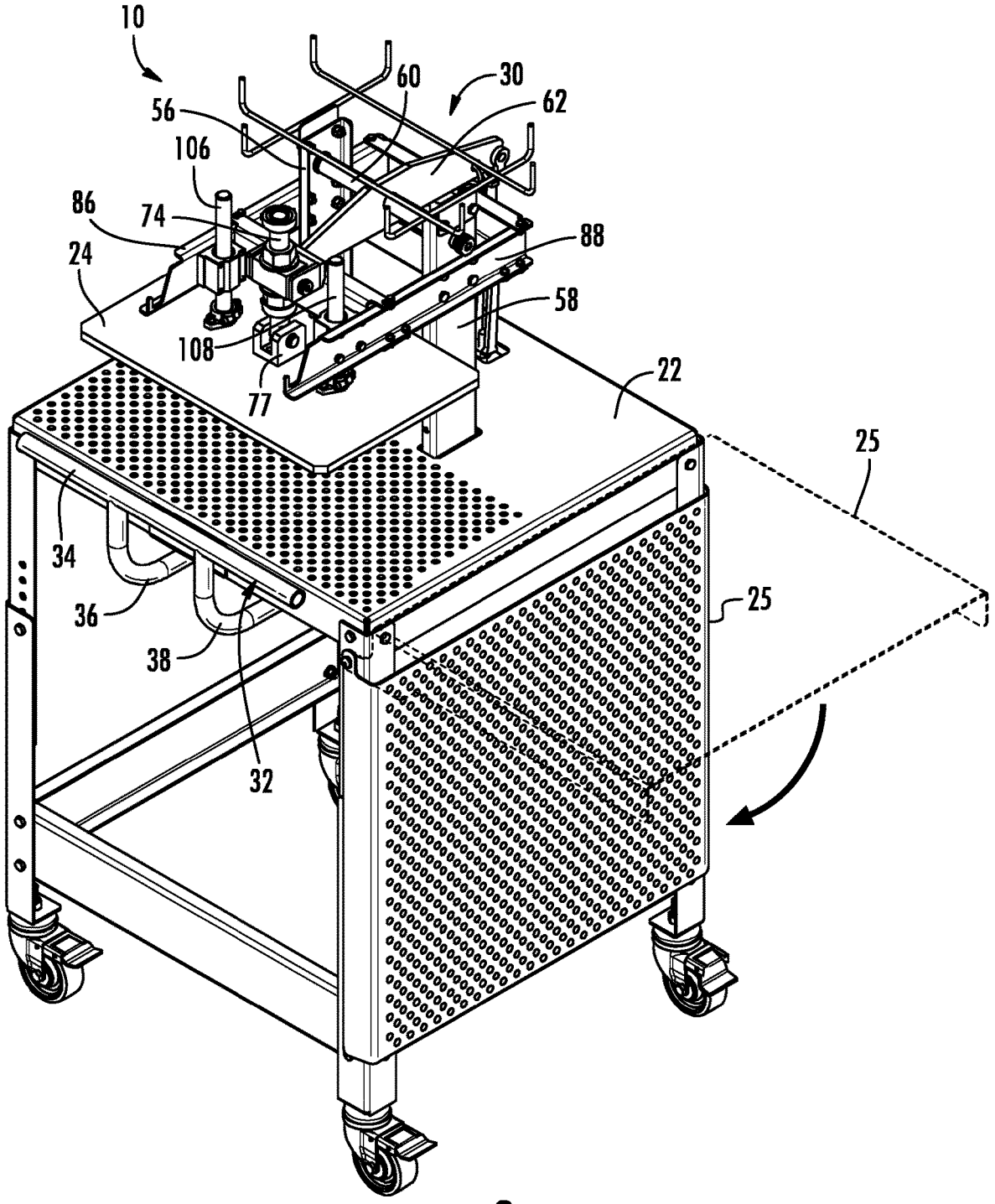
FIG. 8 is a perspective view of an apparatus of FIG. 1, with the articulated portion of the support surface moved to a stowed position.

Referring to FIG. 8, the horizontal support surface 22 of apparatus 10 includes an articulated side support section 25 that can be folded or otherwise lowered into a stowed position, when the apparatus 10 is not in use. When the apparatus 10 is in use, hinged brackets 132 and 134, best seen in FIGS. 3 and 4, are moved from a folded position to unfolded position to support the side section 25 from below. Furthermore, a rack 130 is mounted atop stanchions 56 and 58 of the support frame 54 of actuation assembly 30 for holding a plurality of multi-can engagement collars 12, as best seen in FIG. 1.

Figure 10:
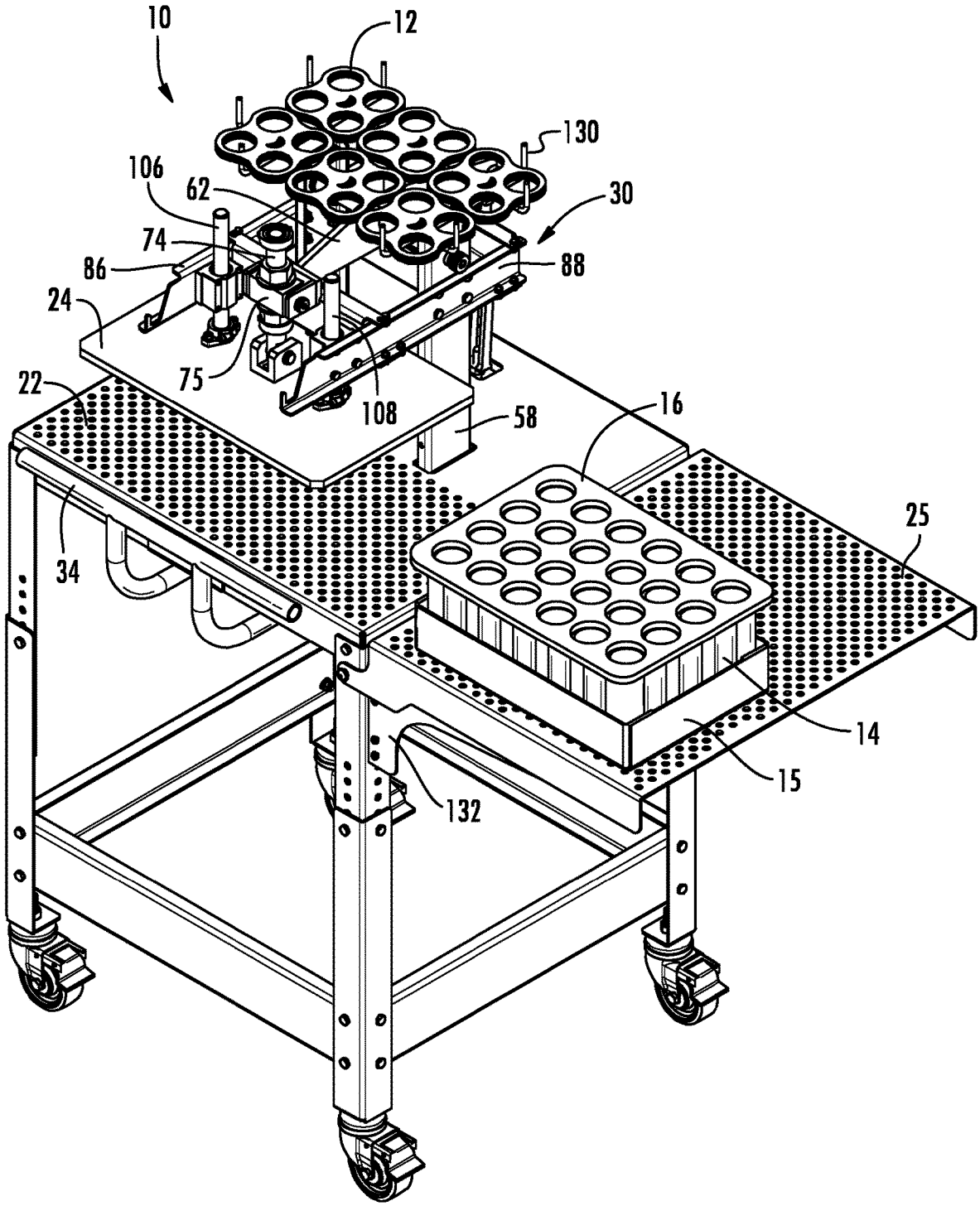
FIG. 10 illustrates the applicator plate positioned on the grouping of beverage cans before it is moved into the application area beneath the press plate.

Referring now to FIGS. 9 through 13, there is illustrated in a logical sequential order, the operative steps for applying the multi-can engagement collar 12 to a group of beverage cans 14 in a package 15 utilizing the apparatus 10 of the subject invention. First, the apparatus 10 is positioned in desired location in a work environment and the brakes 126*a*-126*d* are engaged to lock the castors 124*a*-124*d* in place, as shown in FIG. 9. Thereupon, a multi-can engagement collar 12 is taken from the rack 130 atop support frame 54 and placed into the applicator plate 16 that is retained in its stowed position on support frame 54. Then, the applicator plate 16 with the engagement collar 12 therein is placed on top of the group of beverage cans 14 in package 15, which his located on the articulated section 25 of support surface 22, as shown in FIG. 10.

Figure 11:
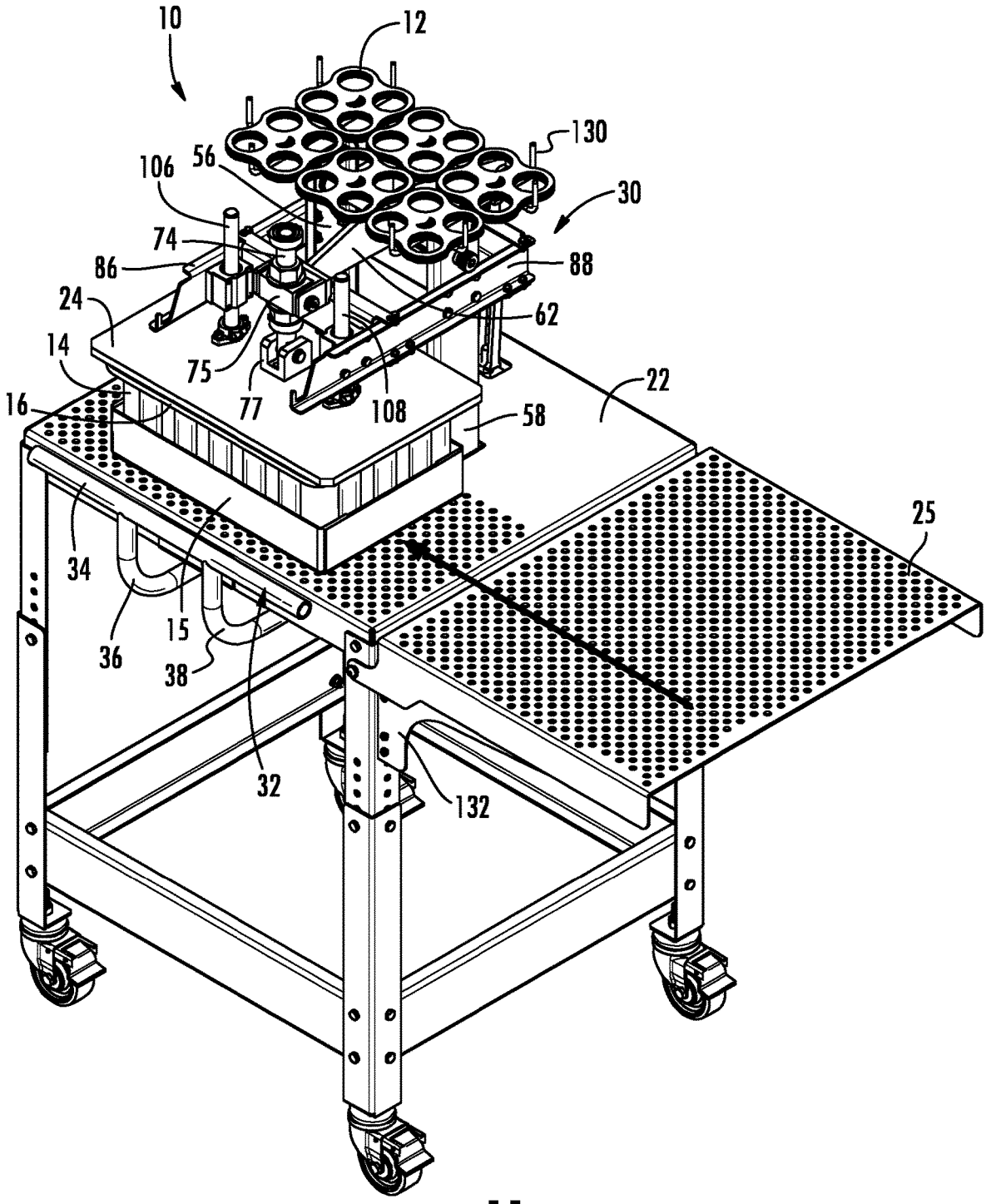
FIG. 11 illustrates the grouping of beverage cans and applicator plate being moved on to the support surface in the application area beneath the press plate.
Figure 12:
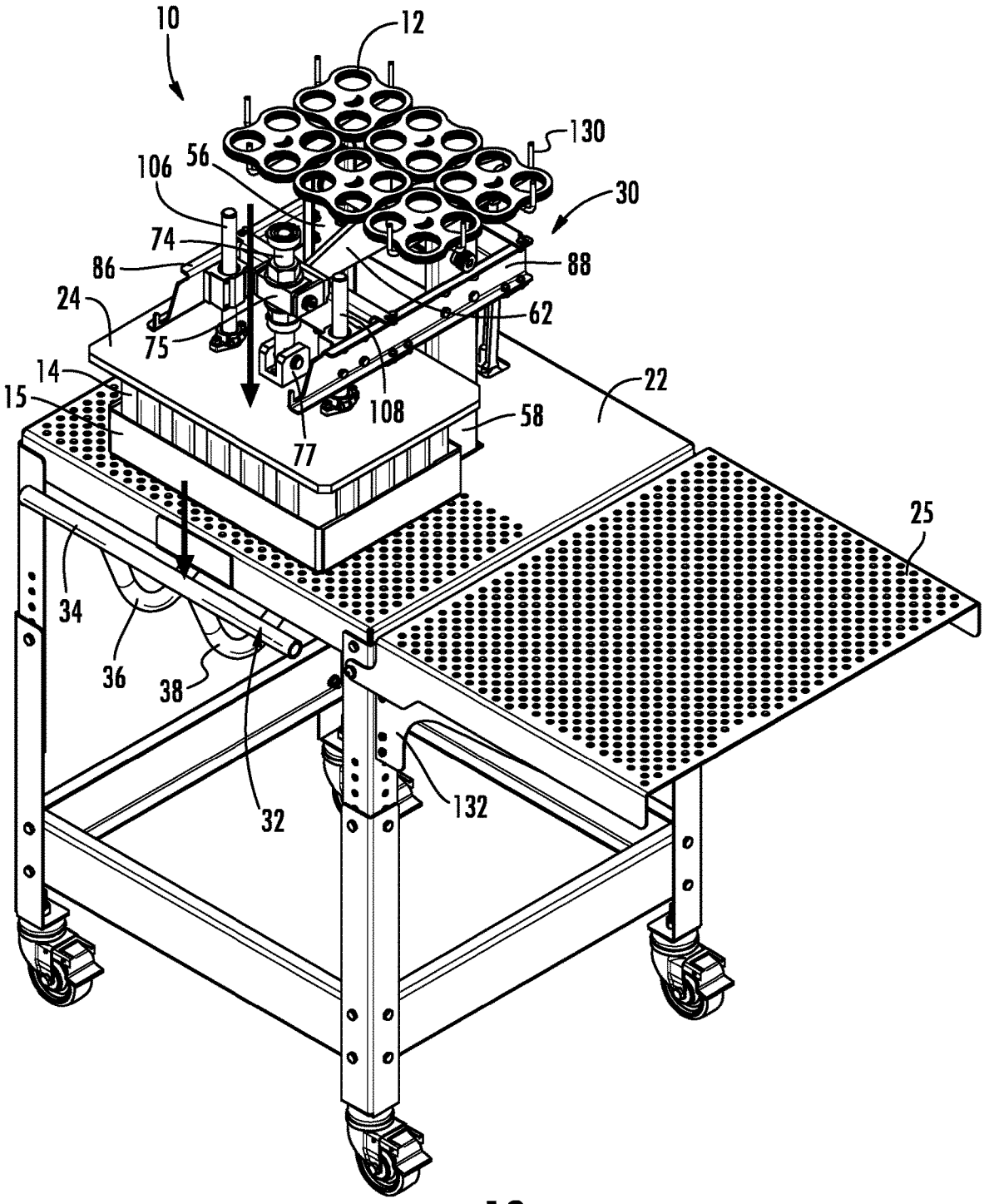
FIG. 12 illustrates the vertical movement of the press plate relative to the support surface of the application area through the movement of the actuation handle.
Figure 13:
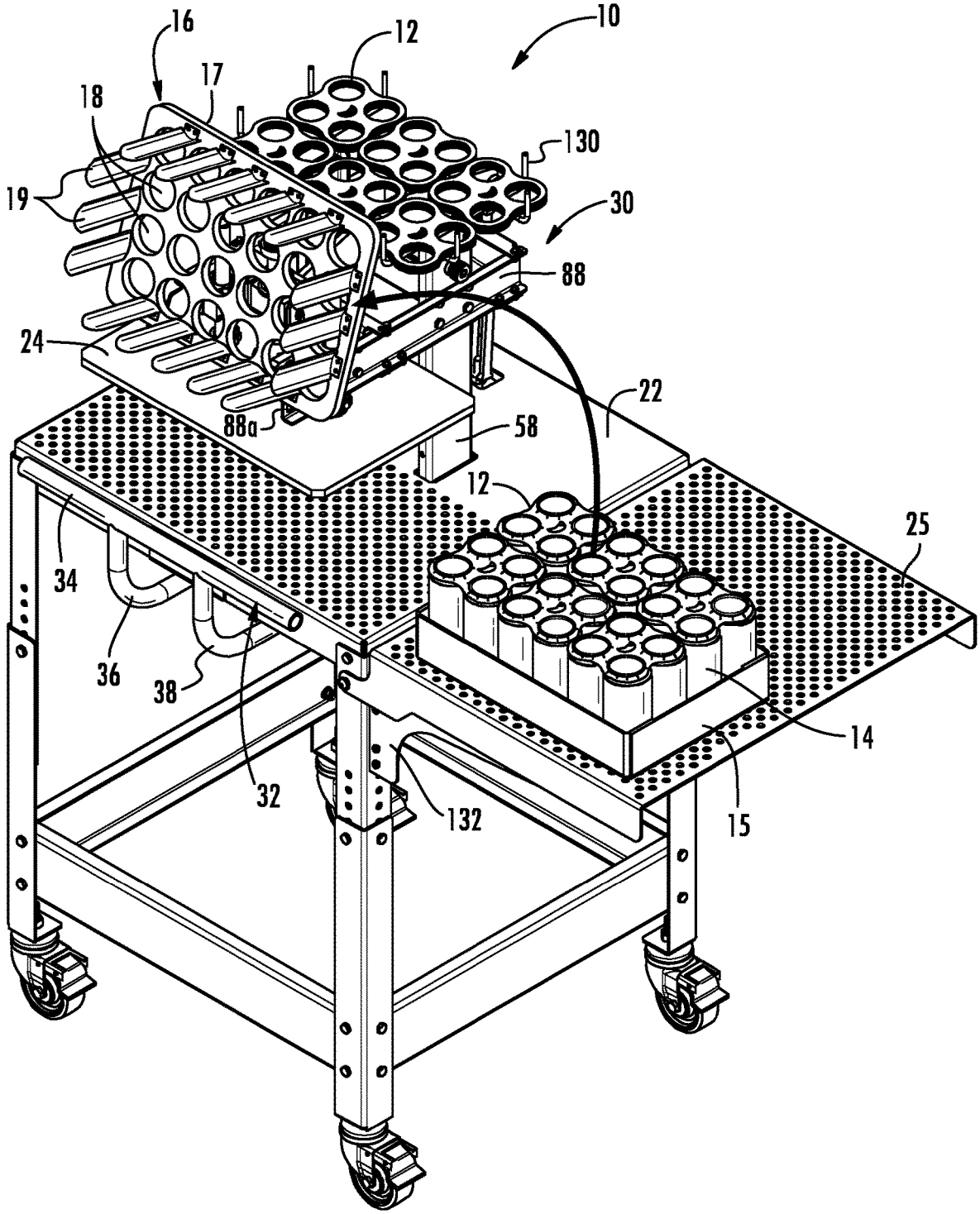
FIG. 13 illustrates the multi-can engagement collar applied to the grouping of beverage cans after removal of the applicator plate.

Thereafter, as shown in FIG. 11, the package is moved into the application area 20 below the press plate 24. The actuation handle 34, which is located below the press plate 24 and in front of the application area 20, is moved downwardly by the user, as depicted in FIG. 12. This causes the turnbuckle 64 to pivot rocker arm 62 about support shaft 60, and thereby urge the ram shaft 74 downwardly. This in turn forces the press plate 24 to move in a vertical direction against the applicator plate 16, resulting in the application of the engagement collar 12 to the group of beverage cans 14 in package 15, as illustrated in FIG. 13.

Figure 14:
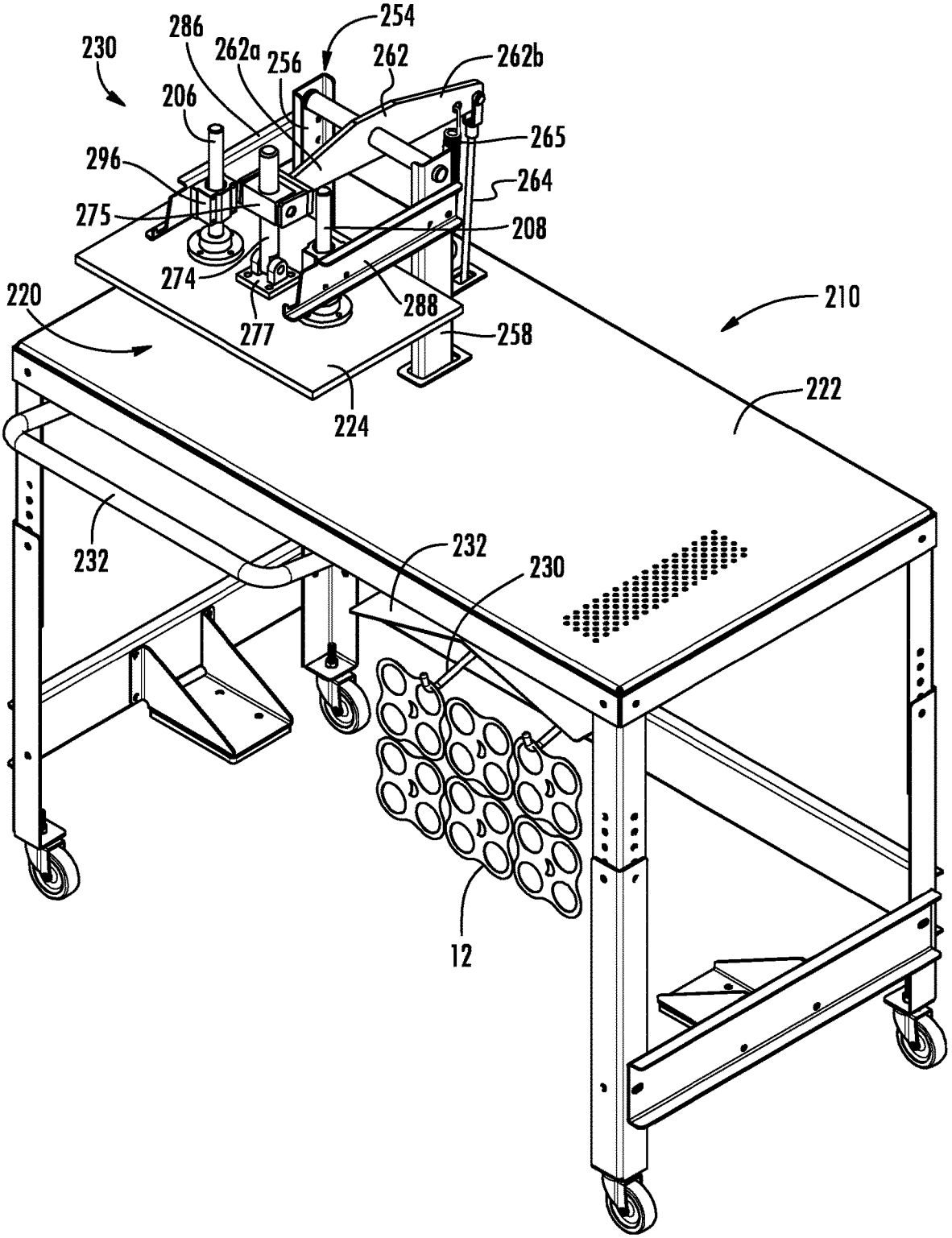
FIG. 14 is a perspective view of another apparatus for applying a multi-can engagement collar to a grouping of beverage cans, which is constructed in accordance with a preferred embodiment of the subject invention.
Figure 15:
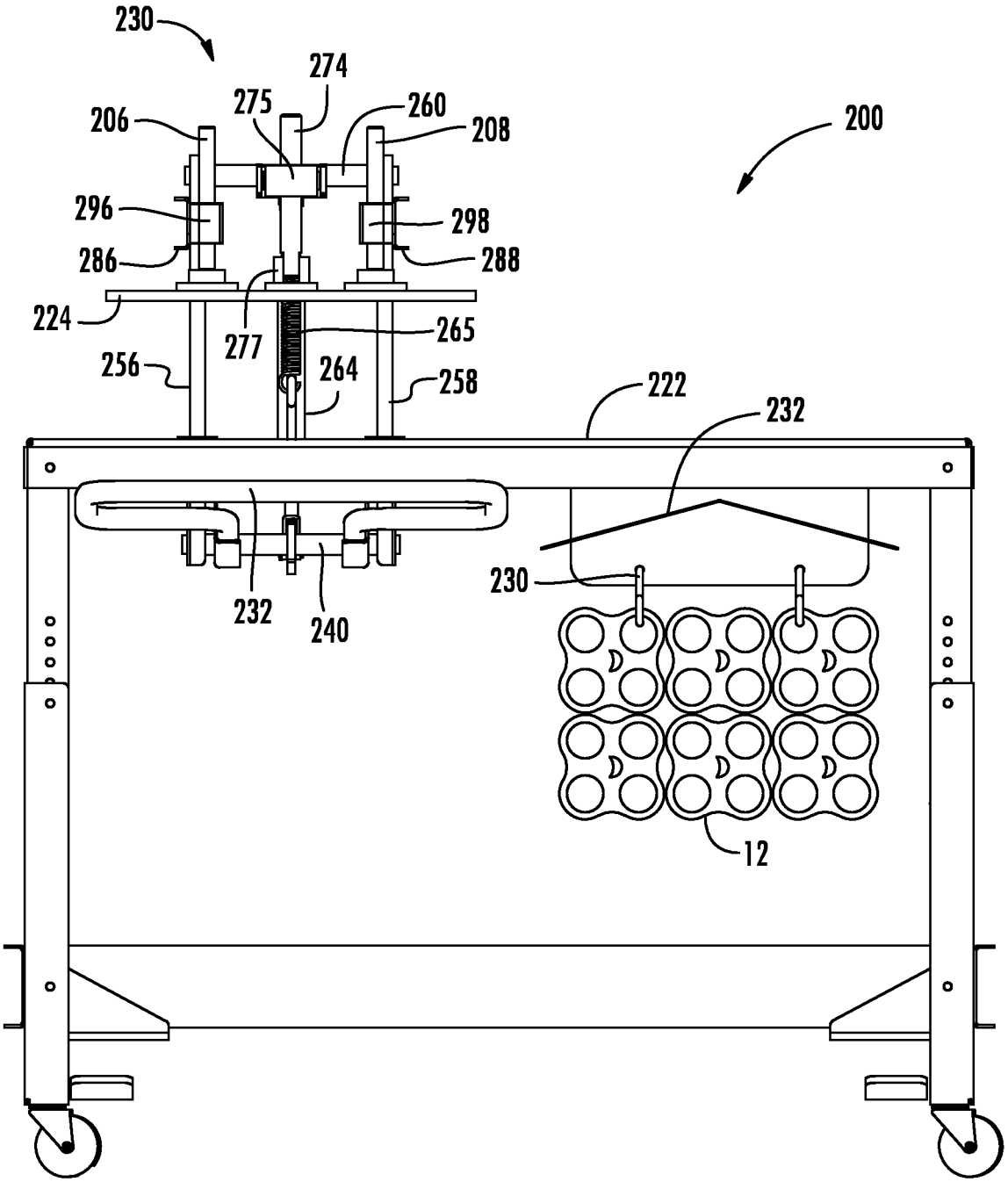
FIG. 15 is a front plan view of the apparatus shown in FIG. 14.
Figure 16:
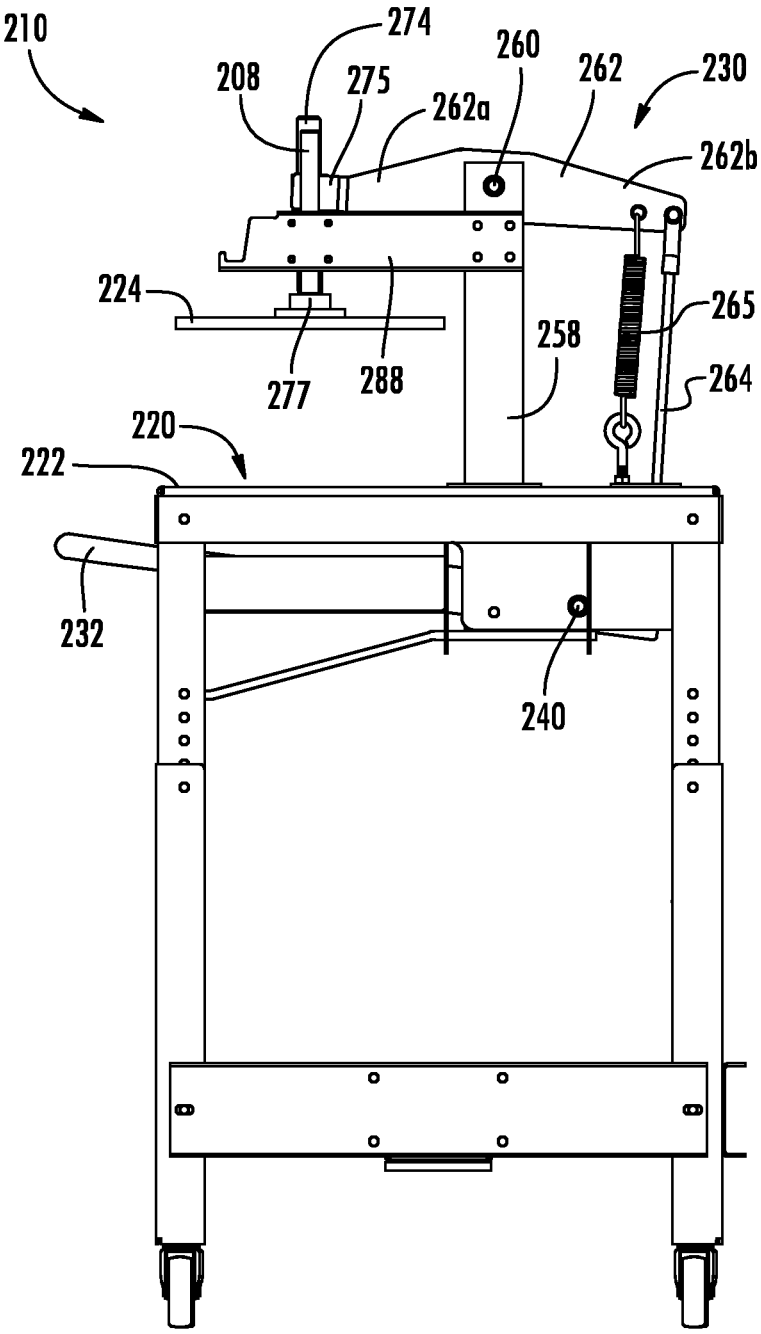
FIG. 16 is a side elevational view of the apparatus shown in FIG. 14.

Referring now to FIGS. 14 through 16, there is illustrated another embodiment of the apparatus for applying a multi-can engagement collar 12 to a grouping of beverage cans, which is constructed in accordance with a preferred embodiment of the subject invention and designated generally by reference numeral 210. The apparatus 210 is similar to the apparatus 10 described above in that it is designed to apply a multi-can engagement collar 12 to the tops of beverage cans grouped in a package.

In addition, like the apparatus 10, apparatus 210 is designed as a mobile unit with casters so that it can be positioned at a desirable location within a work environment. Apparatus 210 also includes an actuation assembly 230 having an actuation lever 232 that is located in a readily accessible location below the press plate 224 and in front of the application area 220, to provide an ergonomic work environment.

In addition, apparatus 210 includes a support frame 254 with a pair of upstanding stanchion 256 and 258 that retain a transverse support shaft 260. A rocker arm 262 pivots about the support shaft 260 and it includes a front end portion 262*a* and a rear end portion 262*b*. The front end portion 262*a* of rocker arm 262 is mounted to a pivot block 275 that is operatively connected to a vertical ram shaft 274 mounted to a horizontal press plate 224 by a clevis bracket 277. The rear end portion 262*b* of rocker arm 262 is connected to a coiled biasing spring 265 and a cross-bar 240 of the actuation handle 232, located beneath the support surface 222, by way of an elongated tie rod 264. The rear end portion 262*b* of rocker arm 262 is also connected to the support surface 222 of apparatus 210 by a coiled biasing spring 265. Outrigger beams 286 and 288 extend respectively from stanchions 256 and 258, which in turn support respective sleeve bearings 296 and 298 and their associated guide shafts 206 and 208.

Apparatus 210 differs from apparatus 10 in that it has a rack 230 located below the support surface 222 for storing a plurality of multi-can engagement collars 12, rather than the rack 130, which is located atop the support frame 54 of the apparatus 10. The rack 260 has a roof top 232 to protect the cardboard collars 12 located therein in the event that any liquids from beverage cans drip through the many holes formed throughout the support surface 222.

While the apparatus of the subject disclosure have been shown and described with reference to preferred embodiments, those skilled in the art will readily appreciate that changes and/or modifications may be made thereto without departing from the scope of the subject disclosure.

What is claimed is:

1. An apparatus, comprising:

a) an application area defining a horizontal support surface for receiving a group of articles;

b) a horizontal press plate positioned above the support surface and mounted for vertical movement relative to the support surface; and c) an actuation assembly operatively connected to the press plate for moving the press plate relative to the support surface to apply an engagement collar to the group of articles positioned on the support surface within the application area, wherein the actuation assembly includes an actuation lever that is located below the press plate in front of the application area.

2. The apparatus of claim 1, wherein the actuation assembly includes a support frame having a pair of stanchions extending vertically upward from the support surface and a support shaft extending horizontally between the pair of stanchions.

3. The apparatus of claim 2, wherein the actuation assembly further includes a rocker arm mounted for rotation about the support shaft, and wherein a front end portion of the rocker arm is operatively connected to the horizontal press plate and a rear end portion of the rocker arm is operatively connected to a rear end portion of the actuation lever.

4. The apparatus of claim 3, wherein the actuation assembly further includes a ram shaft extending vertically upward from the horizontal press plate and including a pivot block to operatively connect the ram shaft to the front end portion of the rocker arm.

5. The apparatus of claim 3, wherein the support frame further includes an outrigger extending horizontally forward from each stanchion, and wherein each outrigger includes a sleeve bearing that supports a guide shaft extending vertically upward from the press plate.

6. The apparatus of claim 4, wherein the ram shaft is configured as a threaded shaft mounted for movement relative to the pivot block to adjust the initial height of the horizontal press plate relative to the support surface.

7. The apparatus of claim 3, wherein the initial height of the actuation lever relative to the support surface is adjustable.

8. The apparatus of claim 7, wherein the initial height of the actuation lever is adjusted by an extendible and retractable turnbuckle assembly operatively extending between the rear end portion of the rocker arm and the actuation lever.

9. The apparatus of claim 1, further comprising an applicator plate adapted and configured for positioning between the press plate and an engagement collar.

10. The apparatus of claim 1, wherein the support surface is mounted on height adjustable telescopic support legs.

11. The apparatus of claim 10, wherein each support leg includes a caster having a brake mechanism.

12. An apparatus, comprising:

a) an application area defining a horizontal support surface for receiving a group of articles;

b) a horizontal press plate positioned above the support surface and mounted for vertical movement relative to the support surface from an initial height;

c) a mechanism for selectively adjusting the initial height of the press plate to accommodate articles of varying size; and d) an actuation assembly operatively connected to the press plate for moving the press plate relative to the support surface to apply an engagement collar to the group of articles positioned on the support surface of the application area, wherein the actuation assembly comprises a rocker arm mounted for rotation about the support shaft, and wherein a front end portion of the rocker arm is operatively connected to the horizontal press plate and a rear end portion of the rocker arm is operatively connected to an actuation lever.

13. The apparatus of claim 12, wherein the actuation assembly includes a support frame having a pair of stanchions extending vertically upward from the support surface and a support shaft extending horizontally between the pair of stanchions.

14. The apparatus of claim 12, wherein the mechanism for selectively adjusting the initial height of the press plate includes a threaded ram shaft that extends vertically upward from the horizontal press plate and is mounted for movement relative to a pivot block that connects the ram shaft to the front end portion of the rocker arm in response to rotation of a pair of adjustable bolts positioned above and below the pivot block.

15. An apparatus, comprising:

a) an application area defining a horizontal support surface for receiving a group of cans;

b) a horizontal press plate positioned above the support surface and mounted for vertical movement relative to the support surface;

c) an actuation handle operatively connected to the press plate for moving the press plate relative to the support surface to apply a multi-can engagement collar to the group of cans positioned on the support surface within the application area, wherein the actuation handle has an initial height relative to the support surface; and d) a mechanism for selectively adjusting, without manual operation of the actuation handle, the initial height of the actuation handle relative to the support surface to accommodate a user.

16. The apparatus of claim 15, wherein the actuation assembly includes a support frame having a pair of stanchions extending vertically upward from the support surface and a support shaft extending horizontally between the pair of stanchions.

17. The apparatus of claim 16, wherein the actuation assembly further includes a rocker arm mounted for rotation about the support shaft, and wherein a front end portion of the rocker arm is operatively connected to the horizontal press plate and a rear end portion of the rocker arm is operatively connected to the actuation lever.

18. The apparatus of claim 17, wherein the mechanism for adjusting the initial height of the actuation handle includes an extendible and retractable turnbuckle assembly operatively extending between the rear end portion of the rocker arm and a rear end portion of the actuation handle.

19. The apparatus of claim 18, wherein the turnbuckle assembly includes an upper threaded clevis portion connected to the rear end portion of the rocker arm, a lower threaded clevis portion connected to the rear end portion of the actuation handle, and a central coupling adjustably connecting the upper and lower threaded clevis portions to one another.

* * * * *